US011442411B2

(12) United States Patent
Hurni

(10) Patent No.: US 11,442,411 B2
(45) Date of Patent: Sep. 13, 2022

(54) TIMEPIECE, IN PARTICULAR A POCKET WATCH, EQUIPPED WITH AT LEAST ONE COVER

(71) Applicant: Montres Jaquet Droz SA, La Chaux-de-Fonds (CH)

(72) Inventor: David Hurni, La Chaux-de-Fonds (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 659 days.

(21) Appl. No.: 16/433,171

(22) Filed: Jun. 6, 2019

(65) Prior Publication Data

US 2020/0004203 A1 Jan. 2, 2020

(30) Foreign Application Priority Data

Jun. 28, 2018 (EP) ..... 18180556

(51) Int. Cl.
*G04B 37/00* (2006.01)
*G04B 3/04* (2006.01)

(52) U.S. Cl.
CPC ..... *G04B 37/0016* (2013.01); *G04B 3/046* (2013.01)

(58) Field of Classification Search
CPC ..... G04B 37/0016; G04B 3/046; G04B 37/0041; G04B 3/041; G04B 15/14; G04B 37/0025; G04B 37/05; G04B 37/081
USPC ..... 368/276, 308
See application file for complete search history.

(56) References Cited

U.S. PATENT DOCUMENTS 296,631 A 4/1884 Schuetz
3,817,026 A * 6/1974 Lopez ..... G04B 37/0016 968/296

FOREIGN PATENT DOCUMENTS

CH 13539 A 7/1897
CH 689 338 A5 2/1999
CH 689338 A5 * 2/1999 ..... G04B 37/0016
JP 4-79295 U 7/1992

OTHER PUBLICATIONS

European Search Report dated Dec. 5, 2018 in European Application 18180556.5 filed on Jun. 28, 2018 (with English Translation of Categories of Cited Documents).
Japanese Office Action dated Aug. 25, 2020 in Patent Application No. 2019-112488 (with English translation), 3 pages.

* cited by examiner

*Primary Examiner* — Edwin A. Leon
(74) *Attorney, Agent, or Firm* — Oblon, McClelland, Maier & Neustadt, L.L.P.

(57) ABSTRACT

A timepiece, in particular a pocket watch, that includes a case delimited by a middle, the timepiece further including at least one cover covering a device for displaying information, as well as a device for controlling the opening of the at least one cover, this control device including a ring pendant and a command transmission member, the ring pendant arranged such that it is pushed in a rectilinear manner a first time towards the middle into a first abutment position, then such that it is rotated in a first direction into a second abutment position, then such that it is pushed in a rectilinear manner a second time towards the middle so as to cause the cover to open by an action on the command transmission member.

10 Claims, 12 Drawing Sheets

TIMEPIECE, IN PARTICULAR A POCKET WATCH, EQUIPPED WITH AT LEAST ONE COVER

CROSS-REFERENCE TO RELATED APPLICATIONS

This application claims priority to European Patent Application No. 18180556.5, filed Jun. 28, 2018 and the entire contents the above applications are hereby incorporated herein by reference in entirety.

TECHNICAL FIELD OF THE INVENTION

The present invention relates to a timepiece, in particular a pocket watch, equipped with at least one cover which conceals, for example, a dial over which moves a set of hands.

TECHNOLOGICAL BACKGROUND OF THE INVENTION

A timepiece of the aforementioned type is, for example, known in the Swiss patent CH 689338 A5 filed by Patek. More specifically, the timepiece described in the Patek patent is a pocket watch provided with a cover on each of the faces thereof, whereby both of these covers can be opened using a mechanism controlled by a stud sliding axially in the crown.

The principle of the Patek mechanism for opening both the top and bottom covers of a pocket watch involves the use of an actuating stud which, depending on the angular position occupied by the pendant, causes one or the other of these two covers to open. In a first position, the pendant is in the upper position, locked angularly in place, and if the user exerts pressure on the stud, it causes the top cover of the wristwatch to open. From this position, if the user moves the pendant slightly towards the middle part, the pendant is angularly unlocked and the user can rotate this pendant in one direction by 180°. When the pendant has been rotated by 180°, the user releases the pendant, which moves axially under a return action and returns to the locked upper position, but at 180° to its first locking position. In this second pendant locking position, the user can cause the bottom cover to open by pushing on the actuating stud.

To achieve this result, the Patek pocket watch comprises a cover on each of the faces thereof, a pendant and a winding and hand-setting mechanism comprising a crown, an hour-wheel and a cylindrical winding stem. The mechanism for opening the covers comprises an actuating stud which slides axially in the winding crown and which, via sliding stems guided by the winding mechanism, acts on locks which, under normal conditions, hold the covers in the closed position.

One of the advantages of the Patek mechanism is the fact that it allows the two covers of the pocket watch to be opened. The Patek mechanism prevents the risk of scratching the watch case if using a knife to open one of the two covers, or from breaking a nail since the click of the cover is usually relatively hard.

However, in the opinion of the applicant, the Patek mechanism has several drawbacks. One of these drawbacks is the fact that the Patek opening mechanism does not seem very practical. More specifically, the Patek opening mechanism is constantly in a position in which a simple press on the actuating stud causes one of the covers to open. As a result, the risk of one of the covers opening unintentionally is high, in particular if the watch is in a pocket of a garment. Moreover, it seems to be fairly difficult to press down on the pendant to bring it from its first locked position into the position wherein it is unlocked and can be rotated 180° without simultaneously actuating the actuating stud and thus causing one of the covers to open, even when this is not the intention. Finally, being required to rotate the pendant 180° to move it from its first to its second locked position also does not appear to be very practical. This is a fairly large movement that cannot be very convenient to perform with a component as small as the pendant of the Patek pocket watch. Moreover, the use of the Patek opening mechanism is not very intuitive. More specifically, the operating mode for opening the top cover and that for opening the bottom cover are not the same. In the case of the top cover, opening thereof is obtained by pressing down on the actuating stud. However, for the bottom cover, opening thereof is obtained by pushing the pendant towards the middle, then by rotating the pendant 180° and finally by pressing down on the actuating stud. As a result, the user, depending on whether he/she is looking to open the top or bottom cover, must perform very different operations, and must remember which manipulations open which cover, which is very inconvenient and unintuitive.

SUMMARY OF THE INVENTION

The purpose of the present invention is to overcome the aforementioned problems as well as others by providing a timepiece, in particular a pocket watch, comprising a mechanical device for opening at least one cover that covers a dial above which at least one hand moves, or that covers a decor, this mechanical opening device having a simple design and being easy to use.

For this purpose, the present invention relates to a timepiece, in particular a pocket watch, comprising a case delimited by a middle, the timepiece further comprising at least one cover covering a device for displaying information, as well as a device for controlling the opening of the at least one cover, this device for controlling cover opening comprising a ring pendant and a command transmission member, the ring pendant being arranged such that it is pushed in a rectilinear manner a first time towards the middle into a first abutment position, then such that it is rotated in a first direction into a second abutment position, then such that it is pushed in a rectilinear manner a second time towards the middle so as to cause the cover to open by an action on the command transmission member.

According to one embodiment of the invention, the timepiece comprises a first and a second cover which respectively cover a first and a second device for displaying information, as well as a device for controlling the opening of the first, and respectively of the second cover, this device for controlling cover opening comprising a ring pendant, as well as a first, and respectively a second command transmission member, the ring pendant being arranged such that it is pushed in a rectilinear manner a first time towards the middle into a first abutment position, then such that it is rotated in a first direction into a second abutment position, then such that it is pushed in a rectilinear manner a second time towards the middle so as to cause the first cover to open by an action on the first command transmission member, the ring pendant being arranged such that it is capable, from the first abutment position, of being rotated in a second direction into a second abutment position, then of being pushed in a rectilinear manner a second time towards the middle in order to cause the second cover to open by an action on the second command transmission member.

Thanks to these features, the present invention provides a timepiece, in particular a pocket watch, comprising at least one cover, the opening thereof being controlled by an action on a pendant, which must firstly be moved in a rectilinear manner towards the middle of the watch, then rotated before being moved again in a rectilinear manner towards the middle in order to open the cover. It is thus understood that any unintentional opening of the cover is not possible. Moreover, in the embodiment wherein the timepiece comprises two covers, the sequence of manipulations that the user must perform in order to open either of the two covers is practically identical, which significantly facilitates use of the timepiece. More specifically, the user does not need to think in order to determine which sequence of manipulations must be performed in order to open the desired cover. It should also be noted that the device for controlling the opening of a cover of the timepiece according to the invention does not involve the use of a push-button; the risks of unintentionally opening of the cover are thus avoided, the reliability of the control device is increased and the cost price is reduced.

BRIEF DESCRIPTION OF THE FIGURES

Other characteristics and advantages of this invention shall be better understood upon reading the following detailed description of one example embodiment of a pocket watch according to the invention, said example being provided for the purposes of illustration only and not intended to limit the scope of the invention, given with reference to the accompanying drawing, wherein.

DETAILED DESCRIPTION OF ONE EMBODIMENT OF THE INVENTION

The present invention was born from the general inventive idea of equipping a timepiece, in particular a pocket watch, with a device for controlling the opening of at least one cover covering a display device. This control device cannot be unintentionally actuated, such that any risk of unintentionally opening the cover is avoided; this control device does not involve the use of a push-button, such that the operation thereof is much more reliable and the cost price thereof is reduced; finally, in the case whereby the timepiece is equipped with two separate covers, the sequence of operations to be performed in order to open either of these two covers is almost identical, such that the use of the timepiece according to the invention is very intuitive.

Figure 1:
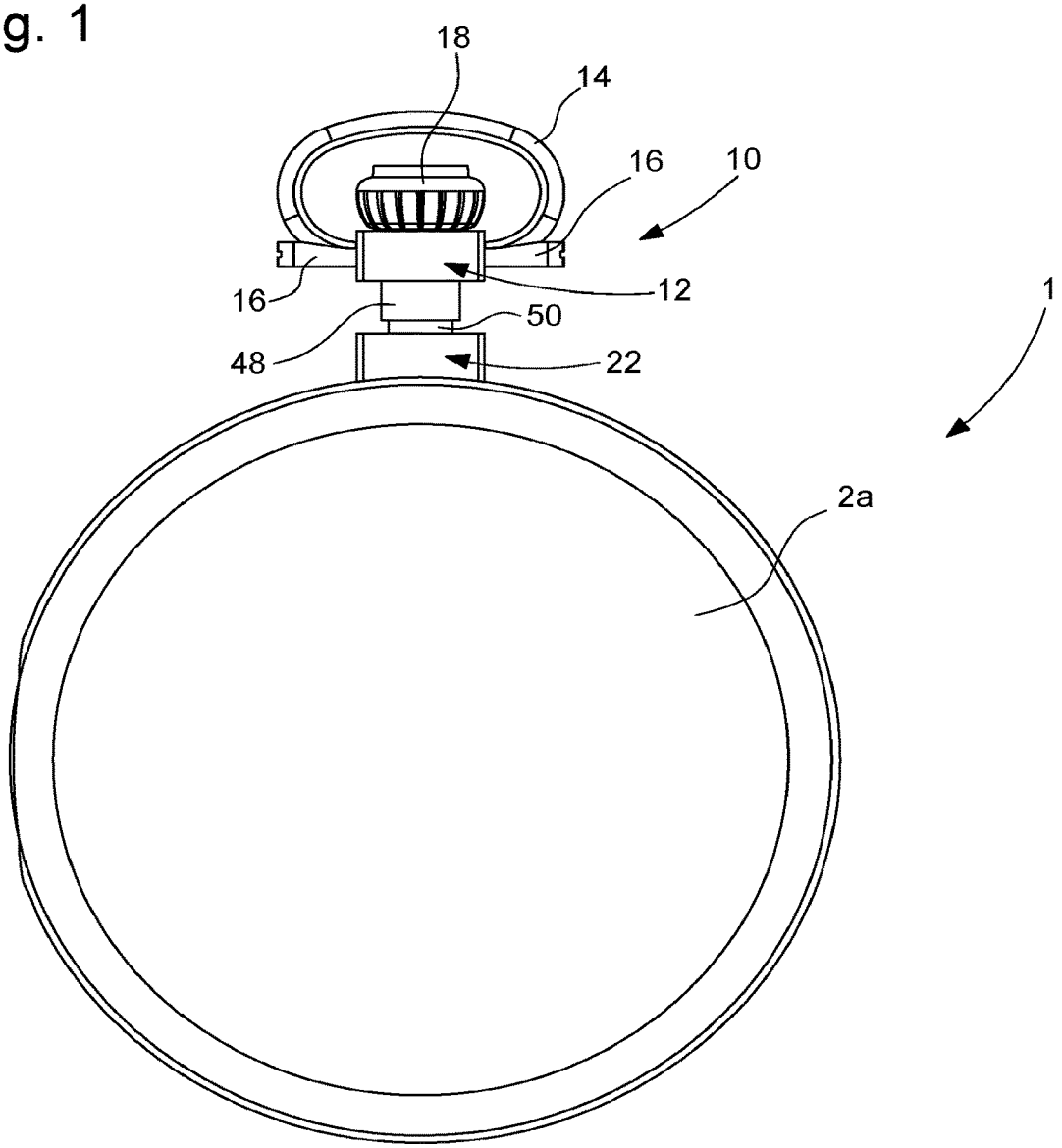
FIG. 1 is a front view of the pocket watch, the first cover thereof being closed.
Figure 2A:
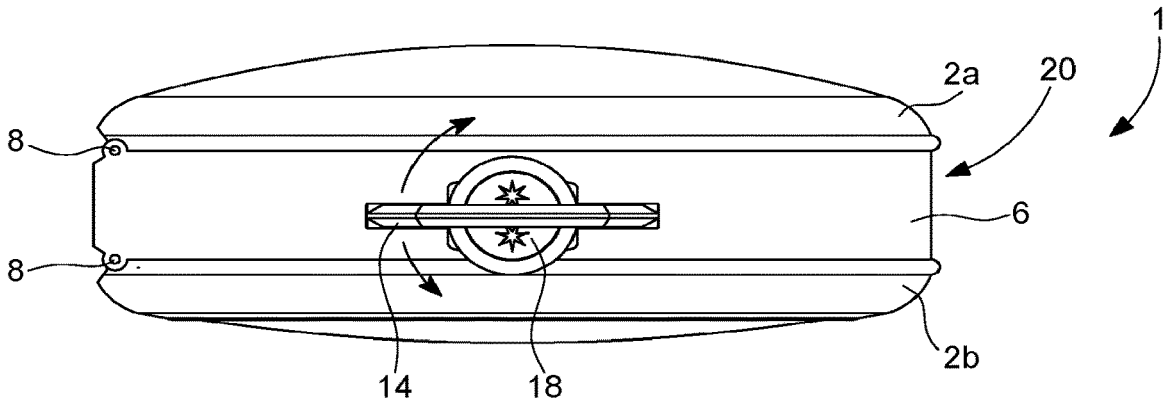
FIG. 2A is a top view, from the side of the ring pendant, of the pocket watch shown in FIG. 1.
Figure 2B:
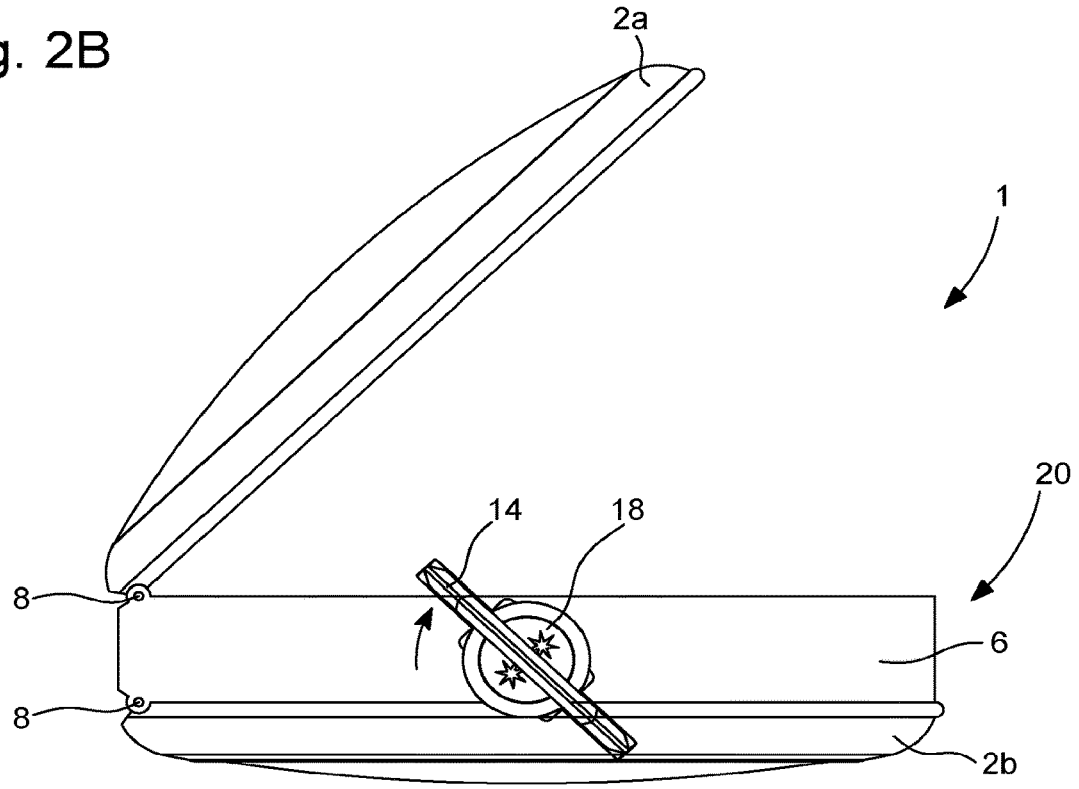
FIG. 2B is a view similar to that in FIG. 2A, wherein the ring pendant has been rotated in a first direction in order to command the opening of the first cover.
Figure 2C:
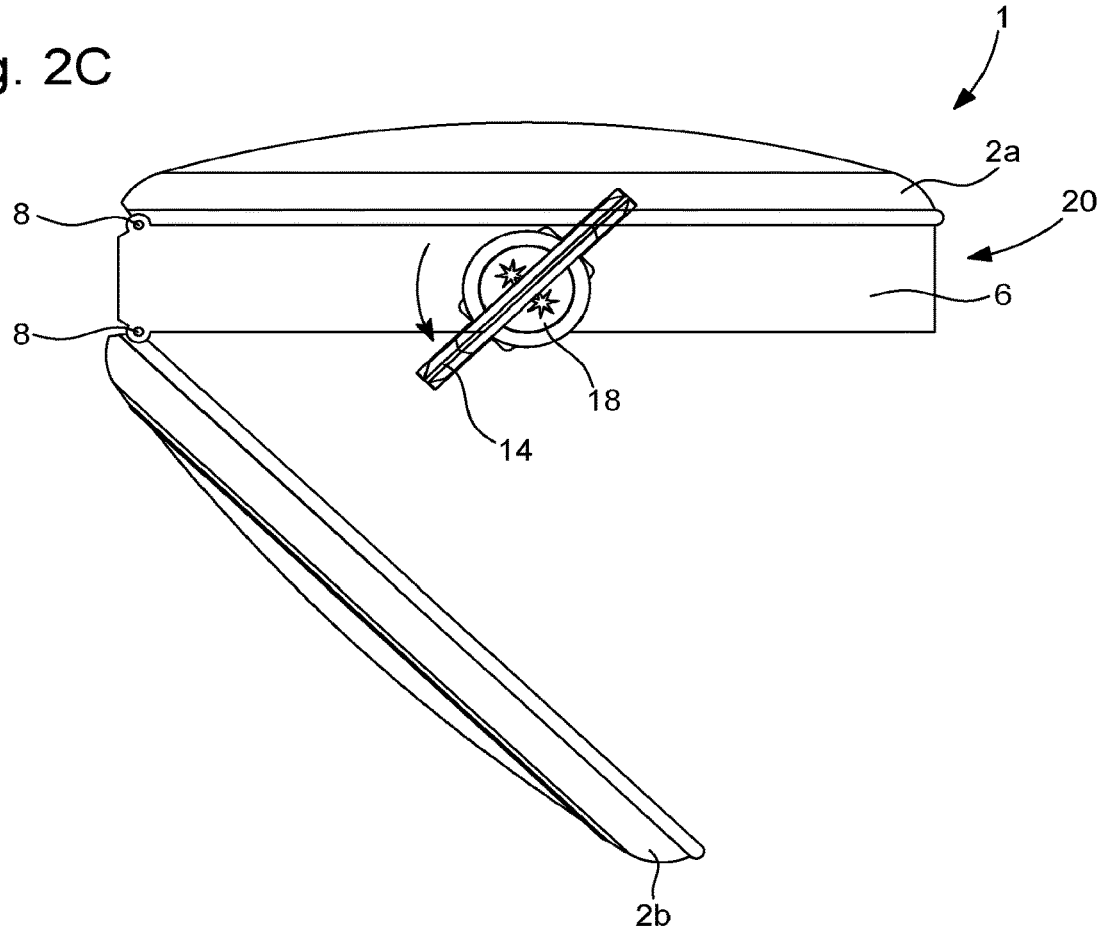
FIG. 2C is a view similar to that in FIG. 2B, wherein the ring pendant has been rotated in a second direction, opposite to the first direction, in order to command the opening of the second cover.
Figure 3A:
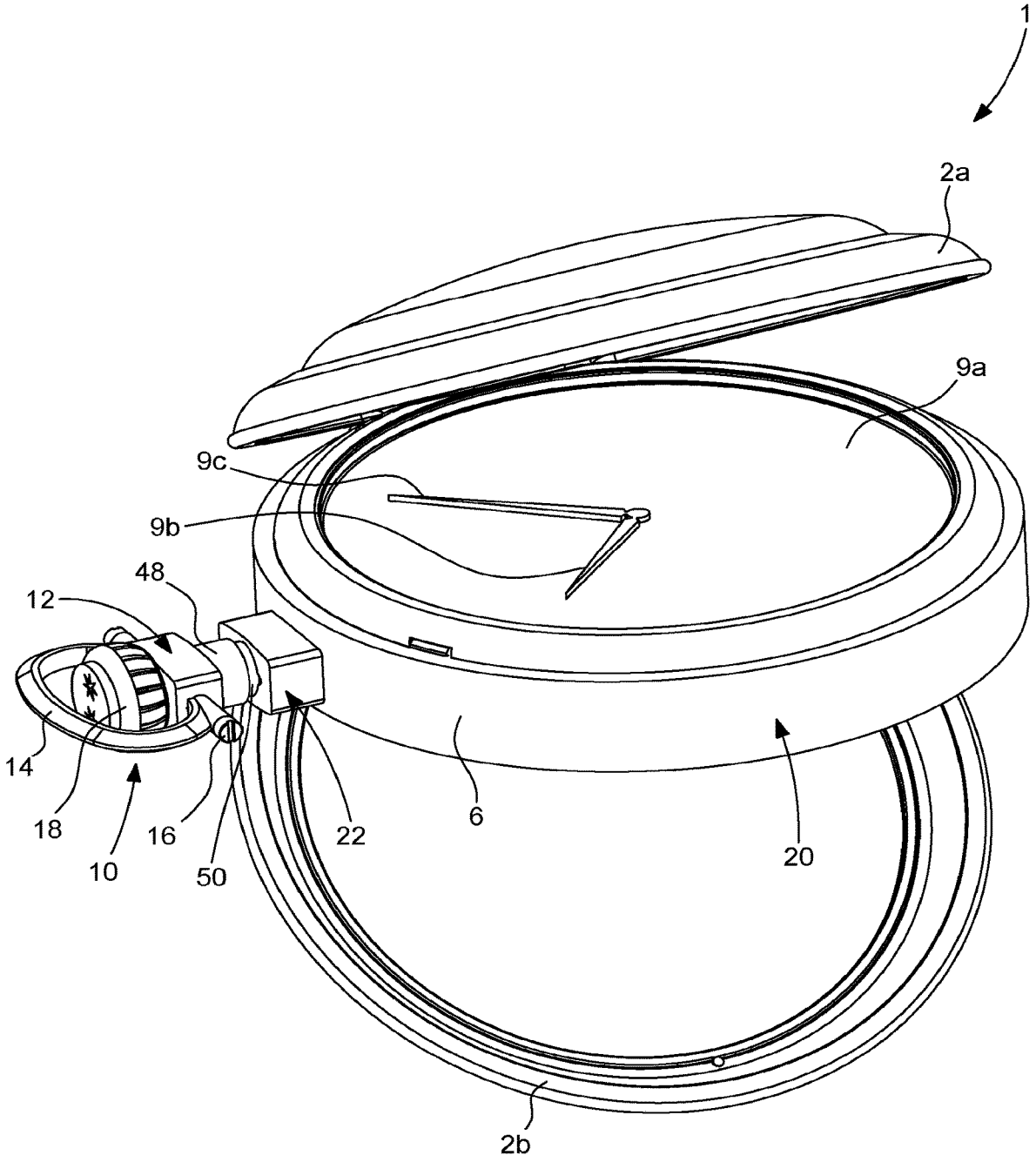
FIG. 3A is a perspective view of the pocket watch, the first and second covers thereof being open, on which a dial showing the time and which is normally covered by the first cover is visible.
Figure 3B:
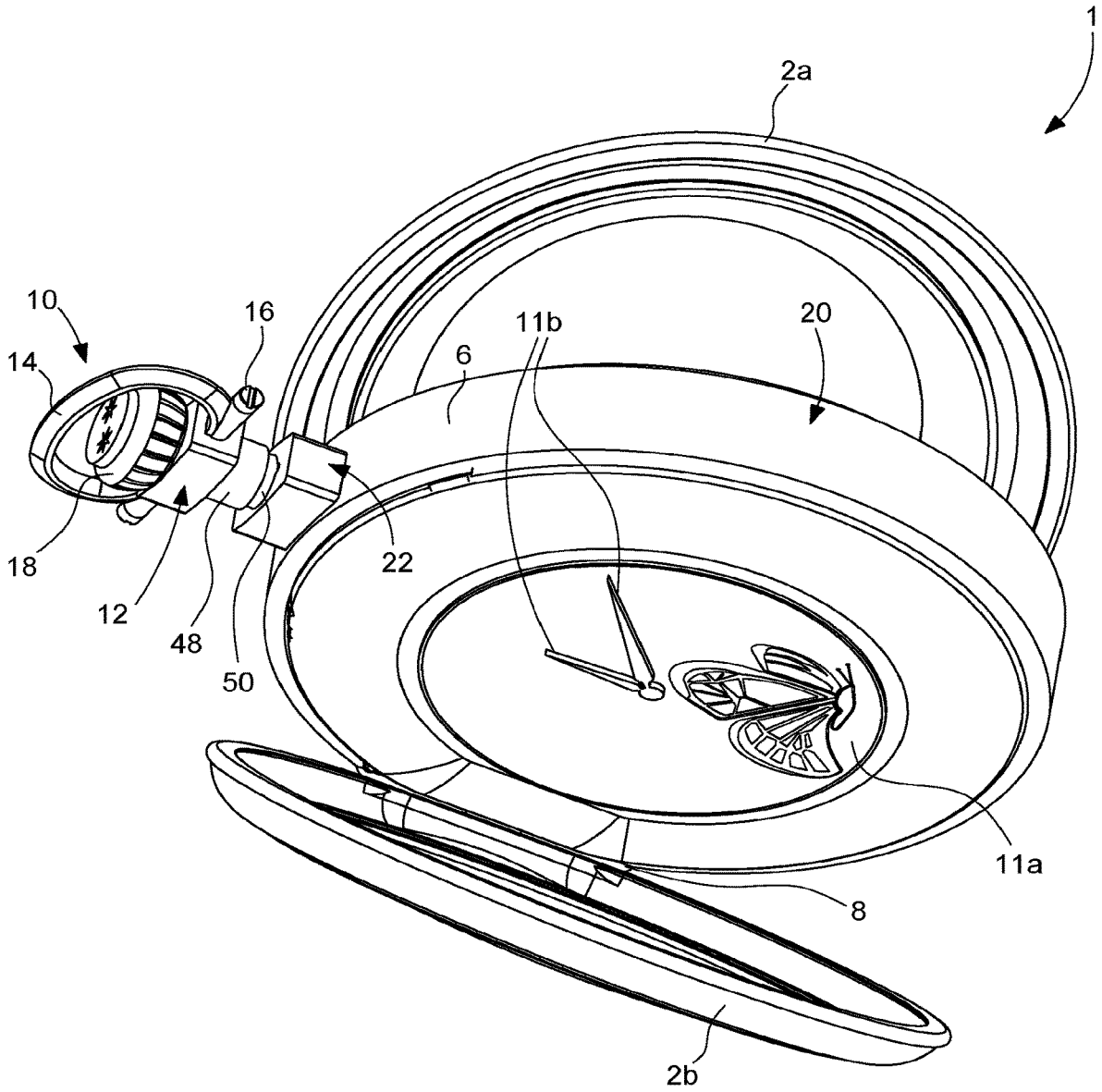
FIG. 3B is a perspective view of the pocket watch, the first and second covers thereof being open, on which a decorative pattern which is normally covered by the second cover is visible.

Denoted as a whole by the general reference numeral 1, the pocket watch according to the invention comprises (see FIGS. 1 and 2A) a first cover 2*a* and a second cover 2*b*. These first and second covers 2*a* and 2*b* are arranged such that they can be opened and closed on demand by the user of the pocket watch 1 (see FIGS. 2B and 2C). For this purpose, the first and second covers 2*a* and 2*b* are mounted such that they rotate about a middle 6 of the pocket watch 1, for example by means of hinges 8. When opening, the first and second covers 2*a* and 2*b* reveal, to the eyes of the user, the devices for displaying information which these first and second covers 2*a* and 2*b* usually cover. For the purposes of illustration only, the first cover 2*a* can cover (see FIG. 3A) a display device such as a dial 9*a* showing the time, over which move, for example, an hour hand 9*b* and a minute hand 9*c*. The second cover 2*b* for its part can cover, for example, (see FIG. 3B) a decorative pattern 11*a*. However, it should be understood that the first and second covers 2*a* and 2*b* can both cover a dial indicating the time, whereby one of these dials indicates, for example, by means of a set of hands, the current time, whereas the other dial 11*b* can, via another set of hands 11*b*, 11*c*, provide an indication of an elapsed time or of a second time zone.

The invention will now be described with reference to a pocket watch equipped with a first and a second cover. However, it should be understood that the invention is in no way limited to this specific embodiment and that the invention applies in an identical manner to the case in which the pocket watch comprises a single cover. It should also be understood that, although described with reference to a pocket watch, the present invention can apply to any type of timepiece equipped with at least one cover, in particular a wristwatch.

The pocket watch according to the invention comprises a device allowing its user to command the opening of the one or more covers. The term "proximal" shall hereafter refer to the elements of the control device situated on the side of the middle of the pocket watch, and the term "distal" shall hereafter refer to the elements of the control device situated on the side of the ring. It shall also be understood that the pipes mentioned hereafter and, more generally, the control device as a whole are centred on a longitudinal axis of symmetry X-X which extends in a radial direction towards the centre of the case of the pocket watch. Similarly, the term "upper" shall refer to an element situated on the side of the ring, and the term "lower" shall refer to an element situated on the side of the middle.

According to the invention, the pocket watch 1 is equipped with a device 10 for controlling the opening of the first and second covers 2*a* and 2*b*. This control device 10 comprises (see FIG. 4) a first pendant 12 which, for the sake of clarity in the description, will hereafter be referred to as the "ring pendant" 12. This ring pendant 12 carries a ring 14, which is mounted on the ring pendant 12 in a removable manner, for example by means of two screws 16. Finally, the ring pendant 12 is surmounted by a crown 18 which is fixed to the ring pendant 12 in a removable manner and which is in particular useful for winding a horological movement housed in a case 20 of the pocket watch 1. This crown 18 will be described in more detail hereinbelow.

The control device 10 further comprises a second pendant 22 which, for the sake of clarity in the description, will hereafter be referred to as the "middle pendant" 22. This middle pendant 22 is fixed to the middle 6 of the case 20 of the pocket watch 1 by any appropriate means, for example by screwing or by welding.

The control device 10 further comprises a first pipe 24 which, for the sake of clarity in the description, will hereafter be referred to as the "ring pipe" 24. The control device 10 further comprises a second pipe 26 which, for the sake of clarity in the description, will hereafter be referred to as the "middle pipe" 26. The middle pipe 26 is fixed inside the middle 6 of the case 20 of the pocket watch 1 by any appropriate means such as by screwing. The ring pipe 24 is, for its part, fixed inside the middle pipe 26, for example by screwing thanks to a thread 28 provided at the distal end thereof. The ring pipe 24 is also equipped, on the outer periphery thereof, with a first collar 30 and a second collar 32 which act as stops. More specifically, the first collar 30, hereafter referred to as the "ring stop", is arranged such that it is at rest on a first bearing surface 34 situated at the bottom of a first housing 36 (ring pendant housing) made in the ring pendant 12. Similarly, the second collar 32, hereafter referred to as the "middle stop", is arranged such that it is at rest against the distal end 38 of the middle pipe 26 when the ring pipe 24 is completely screwed inside the middle pipe 26 (see FIGS. 8 and 9).

The ring pendant 12 is engaged such that it is free to slide on the middle pipe 26 with the interposition of a return spring 42 threaded on the middle pipe 26, which is sandwiched between the ring pendant 12 and the middle 6 of the case 20 of the pocket watch 1.

The ring pendant 12 and the middle pendant 22 have substantially the same shape and dimensions as each other. In the example shown in the figures solely for illustrative purposes and not intended to limit the scope of the invention, the two pendants 12 and 22 are present in the form of a block having an overall parallelepipedal shape, the edges thereof having been bevelled for purely aesthetic purposes only.

Figure 4:
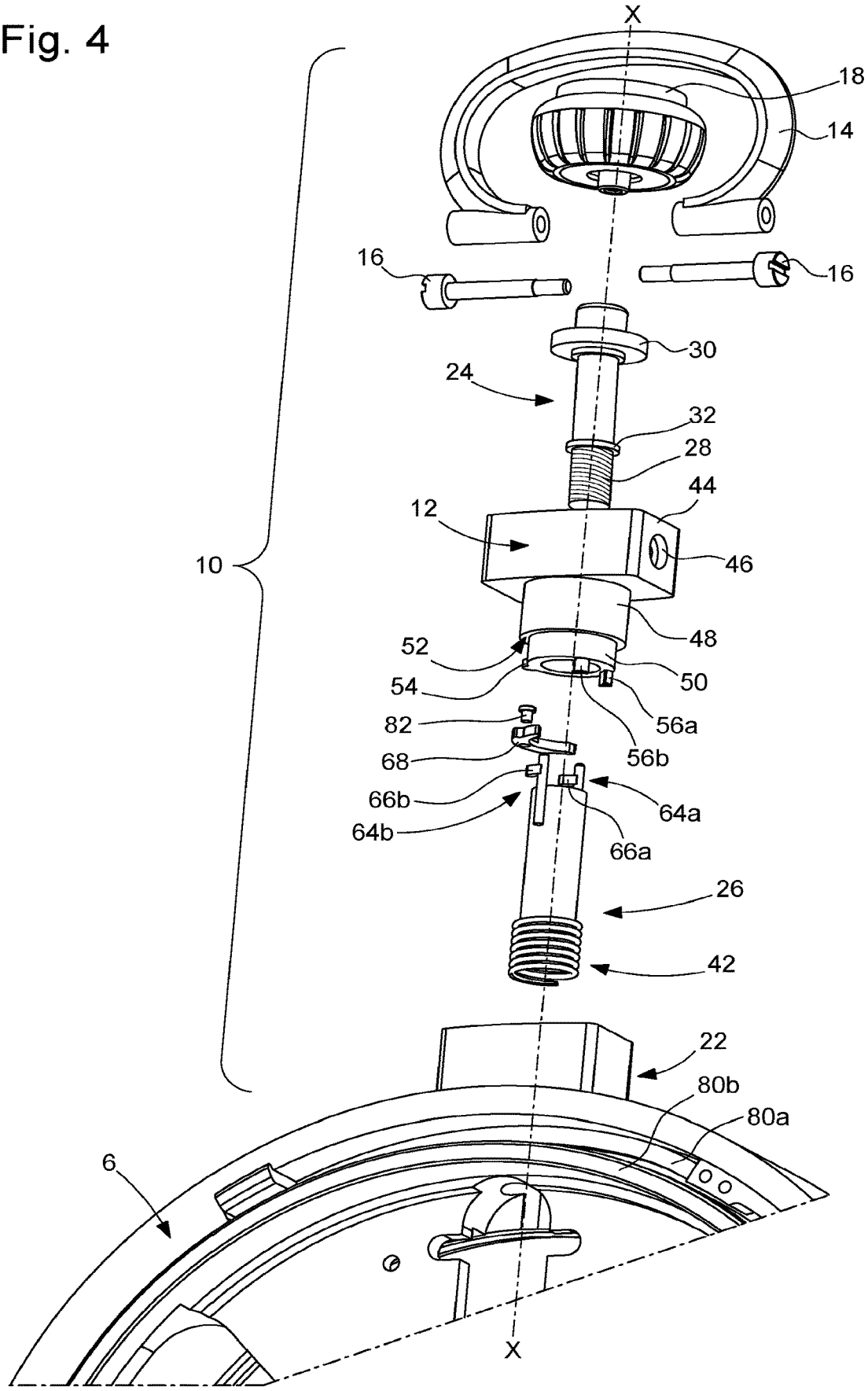
FIG. 4 is an exploded perspective view of the control device according to the invention.

As shown in FIG. 4, each of the small sides 44 of the ring pendant 12 are pierced with a hole 46 for allowing the screws 16 required for assembling the ring 14 onto the ring pendant 12 to be screwed. Moreover, on the proximal side, i.e. when looking towards the centre of the case 20 of the pocket watch 1, the ring pendant 12 is shown to be equipped with a first and a second cylindrical portion, respectively 48 and 50, which are arranged one after the other in the distal/proximal direction, the outer diameter of the first cylindrical portion 48 being greater than the outer diameter of the second cylindrical portion 50, which materialises an annular surface 52 at the junction between these two cylindrical portions 48 and 50.

At its base, the second cylindrical portion 50 of the ring pendant 12 is provided with a safety catch 54 and with a first and a second peg 56*a* and 56*b* respectively (more particularly see FIG. 5A to 5F). In the example shown in the drawing, two pegs are present; however, it is understood upon reading the description hereafter that the ring pendant 12 can be equipped with a single peg, in the case wherein the pocket watch 1 is only equipped with a single cover. The safety catch 54 and the two pegs 56*a* and 56*b* are substantially arranged in the same circle C (see FIG. 5B). The safety catch 54 is made at the base of the second cylindrical portion 50 of the ring pendant 12, on the outer surface of this cylindrical portion 50. The safety catch 54 thus projects from the outer surface of the second cylindrical portion 50. The two pegs 56*a* and 56*b* are, for their part, provided at the bottom of the second cylindrical portion 50, in the continuation of this second cylindrical portion 50. The figure shows that the two pegs 56*a* and 56*b* are arranged at 45° on either side of a diameter D1 that passes through the safety catch 54, and are opposite this safety catch 54. This angular value is provided purely for illustrative purposes only, and other values greater than 0° and less than 90° can also be considered.

Figure 5A:
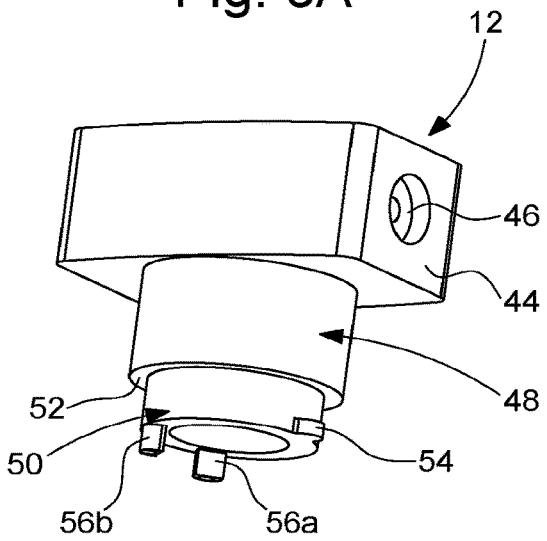
FIGS. 5A, 5B, 5C, 5D, 5E, 5F, 5G, 5H, 5I and 5J are views, taken at the same scale and from different angles, of the ring pendant, of the ring pipe, of the middle pipe and of an actuating pin.
Figure 5B:
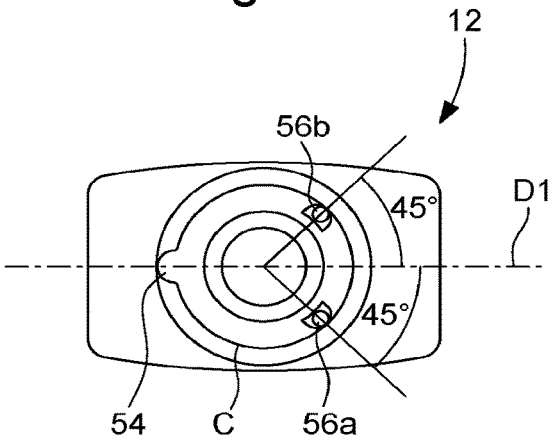
Figure 5C:
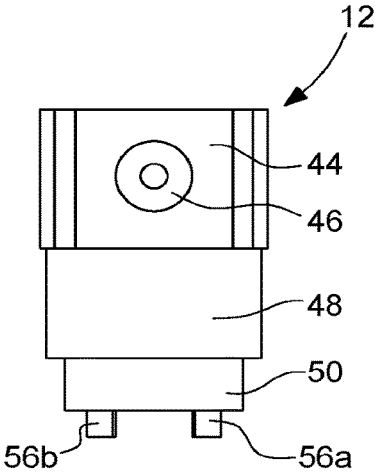
Figure 5D:
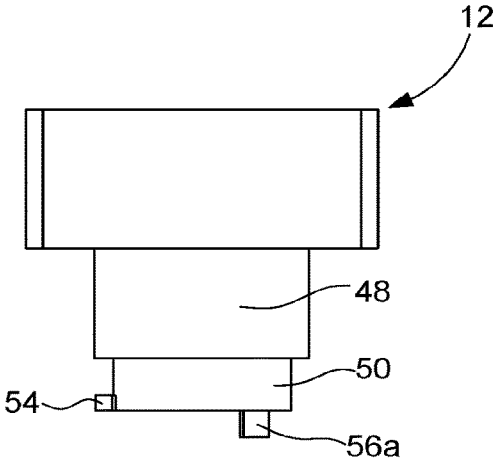
Figure 5E:
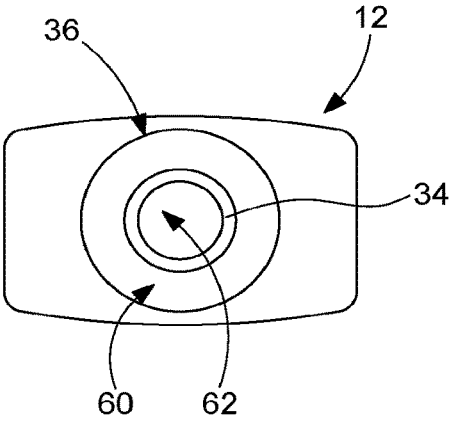
Figure 5F:
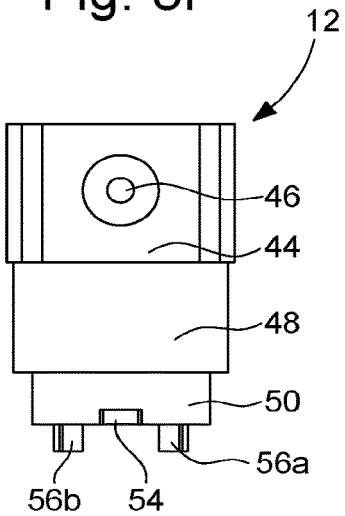
Figure 5G:
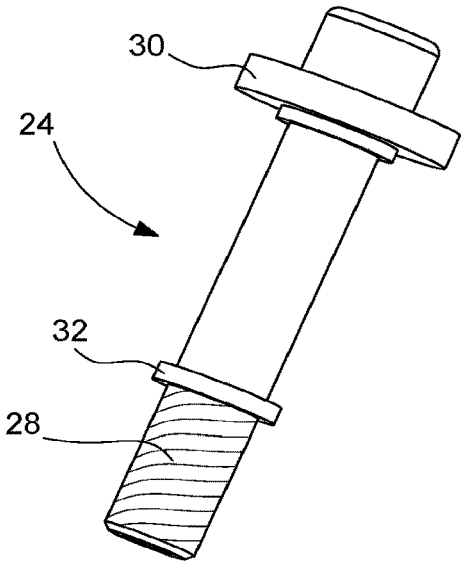
Figure 5H:
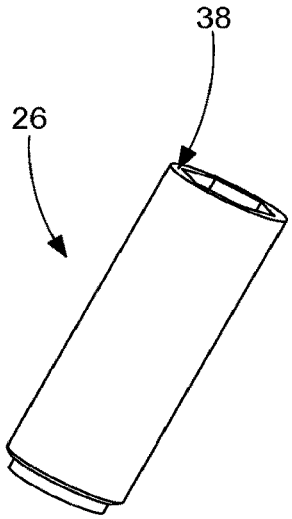
Figure 5J:
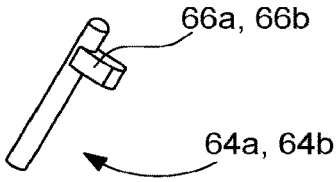
Figure 8:
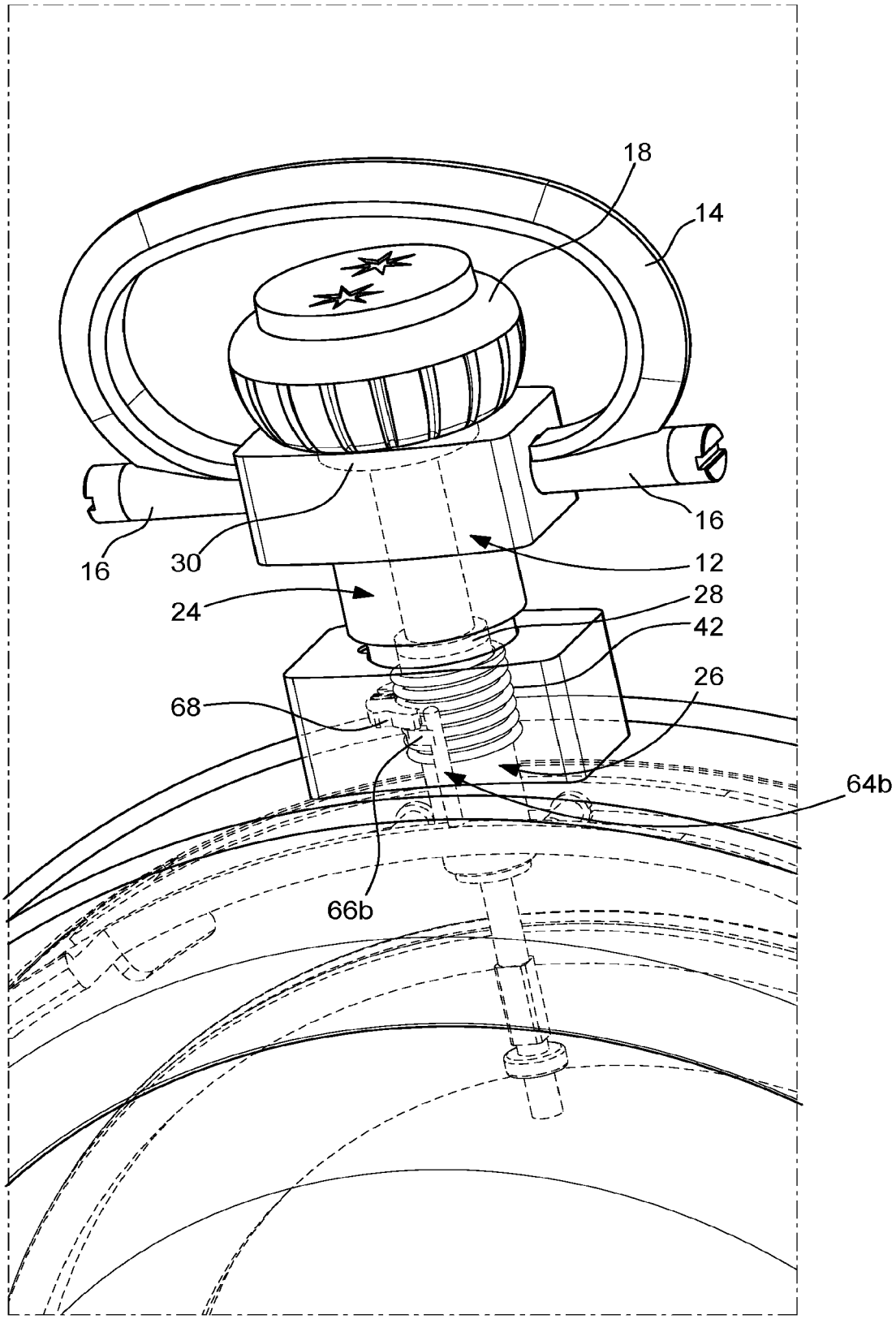
FIG. 8 is a perspective, transparent view of the control device according to the invention.
Figure 9:
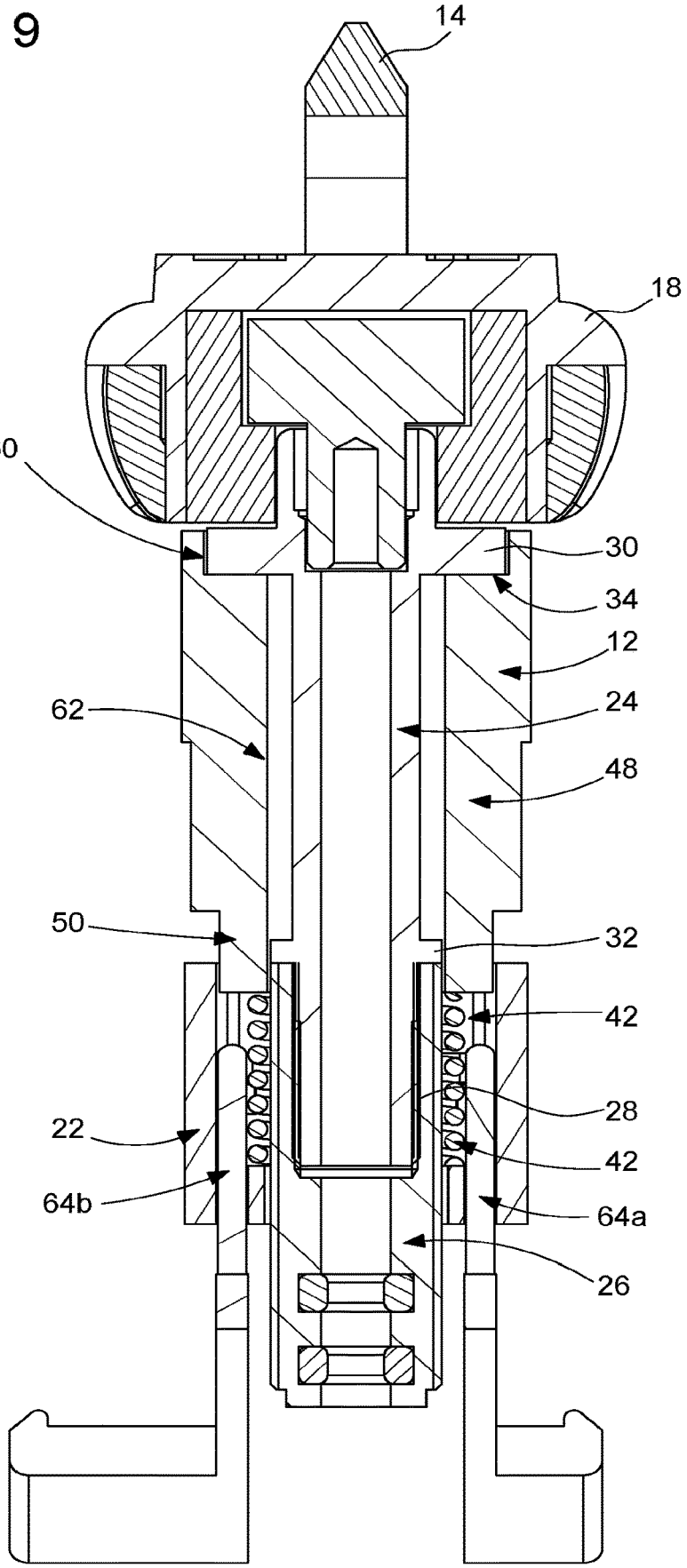
FIG. 9 is a longitudinal sectional view of the control device according to the invention.

The ring pendant 12 which has been said above that it consists of a parallelepipedal block extended in the direction of the middle 6 of the case 20 of the pocket watch 1 by two staggered cylindrical portions 48 and 50, is pierced with a first hole 60 made in the parallelepipedal block (see FIGS. 5E and 8). The inner diameter of this first hole 60 is large enough to allow the first collar 30 (also referred to as the ring stop) to pass therethrough, which collar abuts against the first bearing surface 34 formed by a local narrowing of the inner diameter of the first hole 60. A second hole 62, the inner diameter thereof being slightly greater than the outer diameter of the second collar 32 (also referred to as the middle stop) in order to allow this second collar 32 to pass therethrough, is, for its part, pierced in the first and second cylindrical portions 48 and 50.

The control device 10 further comprises a first and a second control transmission member, for example of the type of a first and a second actuating pin 64*a*, 64*b*, each of which is provided with a catch 66*a*, respectively 66*b*, and a holding plate 68, the roles whereof will be described in more detail hereinbelow. In the case wherein the pocket watch 1 according to the invention only comprises a single cover, only one actuating pin is required.

Figure 5I:
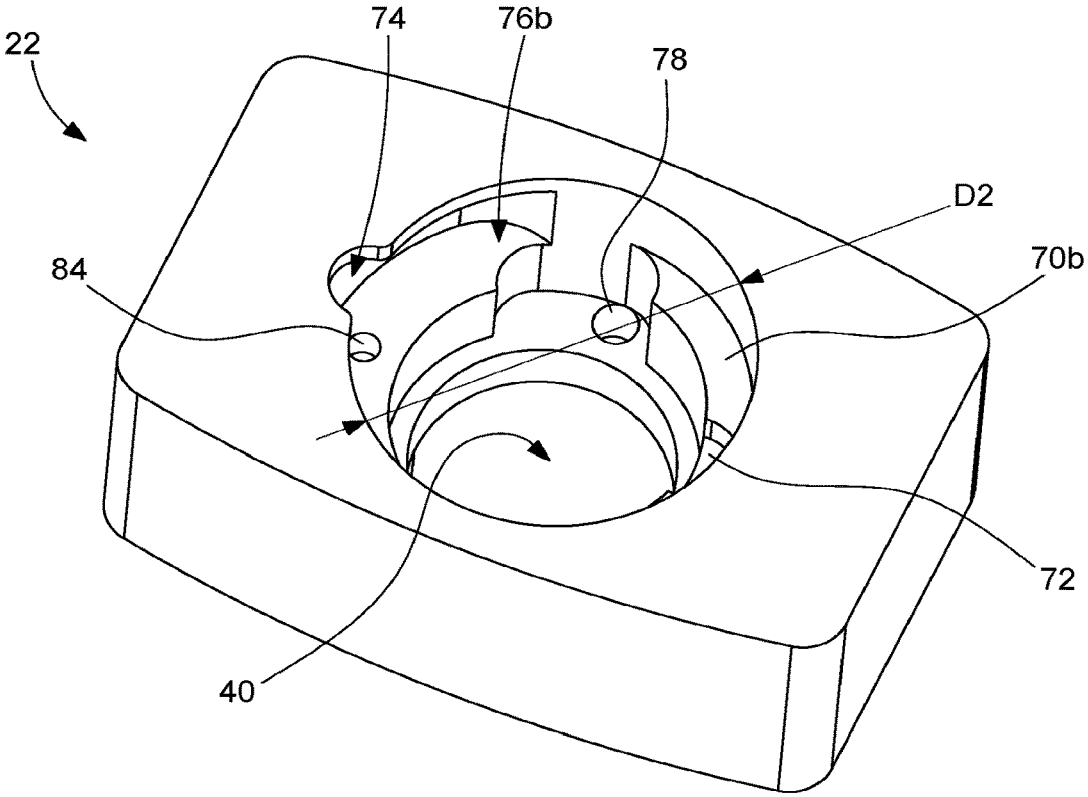
Figure 6A:
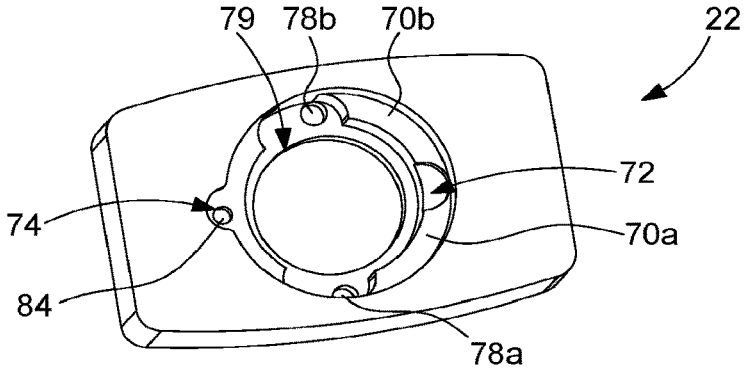
FIGS. 6A and 6B are overhead views of the middle pendant.
Figure 6B:
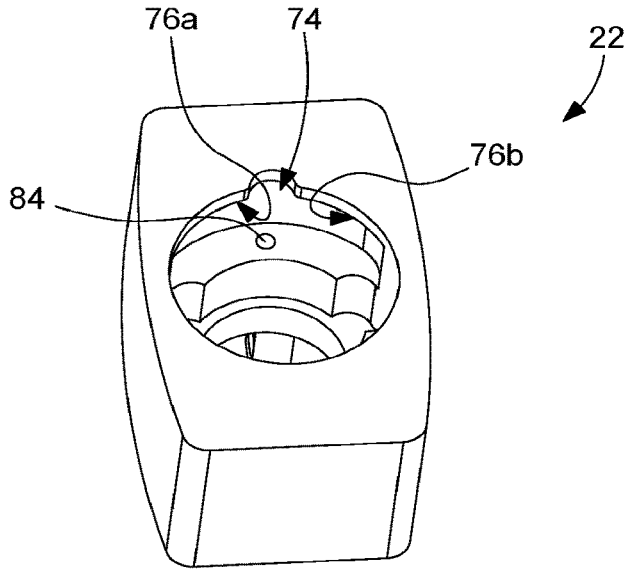
Figure 7A:
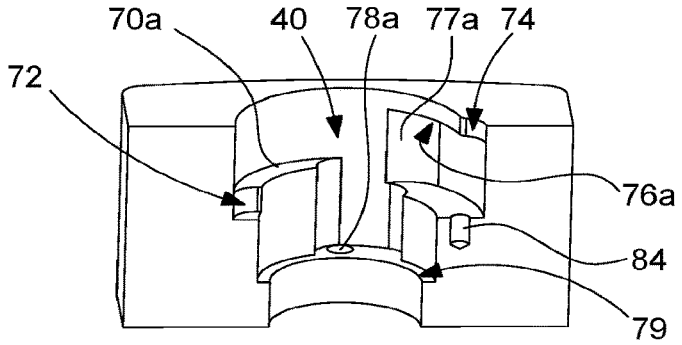
FIGS. 7A and 7B are views of the two parts of the middle pendant cut along a vertical median plane.
Figure 7B:
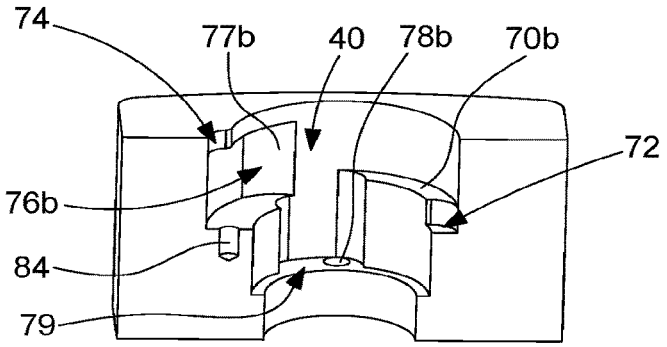

The second housing 40, also referred to as the middle pendant housing, passes through the middle pendant 22 from end to end (see FIG. 5I). This second housing 40 has an overall cylindrical shape with a diameter D2, and is centred on the longitudinal axis of symmetry X-X. This second housing 40 has, on the inside thereof (see FIGS. 6A, 6B and 7A, 7B) a first and a second rim, respectively 70*a* and 70*b*. Each of these rims 70*a*, 70*b*, which have the shape of an arc of a circle, extend over substantially 90° and are arranged one after the other, with the presence of a clearance 72 between the two. Moreover, a semi-cylindrical notch 74 which extends along the longitudinal axis of symmetry X-X is made in the inner side wall of the second housing 40, exactly opposite the clearance 72. This semi-cylindrical notch 74 is intended to allow the safety catch 54 to pass when the ring pendant 12 is inserted into the middle pendant 22. The semi-cylindrical notch 74 opens out into a first and a second groove 76*a* and 76*b* in the shape of arcs of a circle which extend on either side of the notch 74 over an angular sector of approximately 45° and which are each delimited by a milling bottom stop 77*a*, 77*b* (in particular see FIGS. 7A and 7B). It should be understood that, in the case wherein the pocket watch 1 only comprises one cover, only one groove is required. It should also be understood from reading the following description that, depending on whether the first cover 2*a* or the second cover 2*b* is to be opened, performance of the opening operation will result in the safety catch 54 sliding either in the first groove 76*a* or in the second groove 76*b*.

The first and second actuating pins 64*a*, 64*b* are inserted into first and second bores, respectively 78*a* and 78*b*, axially pierced in a second bearing surface 79 provided in the base of the middle pendant housing 40. These first and second actuating pins 64*a*, 64*b* are retained in the bores 78*a*, 78*b* thanks to the catches 66*a*, 66*b* thereof, which are at rest on the second bearing surface 79 and which prevent these actuating pins 64*a*, 64*b* from leaving the bores 78*a*, 78*b* axially in the direction of the middle 6. At the end thereof opposite the catches 66*a*, 66*b*, the first and second actuating pins 64, 64*b* are at rest on a first, and respectively a second locking spring 80*a*, 80*b*, which are arranged in the case 20 of the pocket watch 1 and which control the opening of the corresponding cover 2*a*, 2*b*. The bores 78*a*, 78*b* are machined in the second bearing surface 79 of the middle pendant housing 40 such that they are diametrically opposite one another and situated at substantially 90° on either side of the semi-cylindrical notch 74. Moreover, the holding plate 68 is shaped such that it is situated above the catches 66*a*, 66*b* of the actuating pins 64*a*, 64*b* and prevents these actuating pins 64*a*, 64*b* from leaving the bores 78*a*, 78*b* axially in the direction of the ring pendant 12. This holding plate 68 is fixed in the middle pendant housing 40 by means of at least one screw 82 screwed into a threaded hole 84 machined vertically to the semi-circular notch 74, at the point where the first and second grooves 76*a*, 76*b* meet. It is now important to note that the holding plate 68 is mounted such that a slight axial play remains between the catches 66*a*, 66*b* and the second bearing surface 79, this play defining the travel of the actuating pins 64*a*, 64*b*, which allows them to actuate the locking springs 80*a*, 80*b* of the first and second covers 2*a*, 2*b*.

The control device 10 is mounted as follows: with the middle pendant 22 fixed onto the middle 6 of the case 20 of the pocket watch 1, the middle pipe 26 is engaged in the middle pendant housing 40 and is screwed into the middle 6. Then, the return spring 42 is threaded onto the middle pipe 26, the first and second actuating pins 64*a*, 64*b* are inserted into the first and second bores 78*a*, 78*b*, then the holding plate 68 is screwed into the bottom of the middle pendant housing 40, above the actuating pins 64*a*, 64*b*. The ring pendant 12 is then engaged in the middle pendant 22. To achieve this, the ring pendant 12 must be oriented such that the safety catch 54 can penetrate the semi-cylindrical notch 74. The ring pipe 24 is then engaged in the ring pendant 12 and screwed into the middle pipe 26 until the second collar or middle stop 32 of the ring pipe 24 abuts against the distal end 38 of the middle pipe 26. At this point of the assembly process, the ring pendant 12 cannot be lost and is free to slide axially along the middle pipe 26 towards the centre of the case 20 of the pocket watch 1 counter to the return force of the return spring 42. The axial travel of the ring pendant 12 is determined by the distance that separates the first collar 30 of the ring pipe 24 from the second collar 32 of the same ring pipe 24. Finally, the crown 18 is fixed, in a removable manner, to the proximal end of the ring pipe 24, and the ring 14 is fixed onto the ring pendant 12 by means of the screws 16. It is important to note that the crown 18 is in particular intended to wind a horological movement housed inside the case 20 of the pocket watch 1 and does not play any role in the functioning of the control device 10 with which the pocket watch 1 according to the invention is equipped. Similarly, the ring 14 is present for aesthetic and technical purposes (to facilitate actuation of the control device 10 and to protect the crown 18 from the risk of being ripped away or unintentionally operated), but is not essential to the correct operation of the control device 10.

Figure 10:
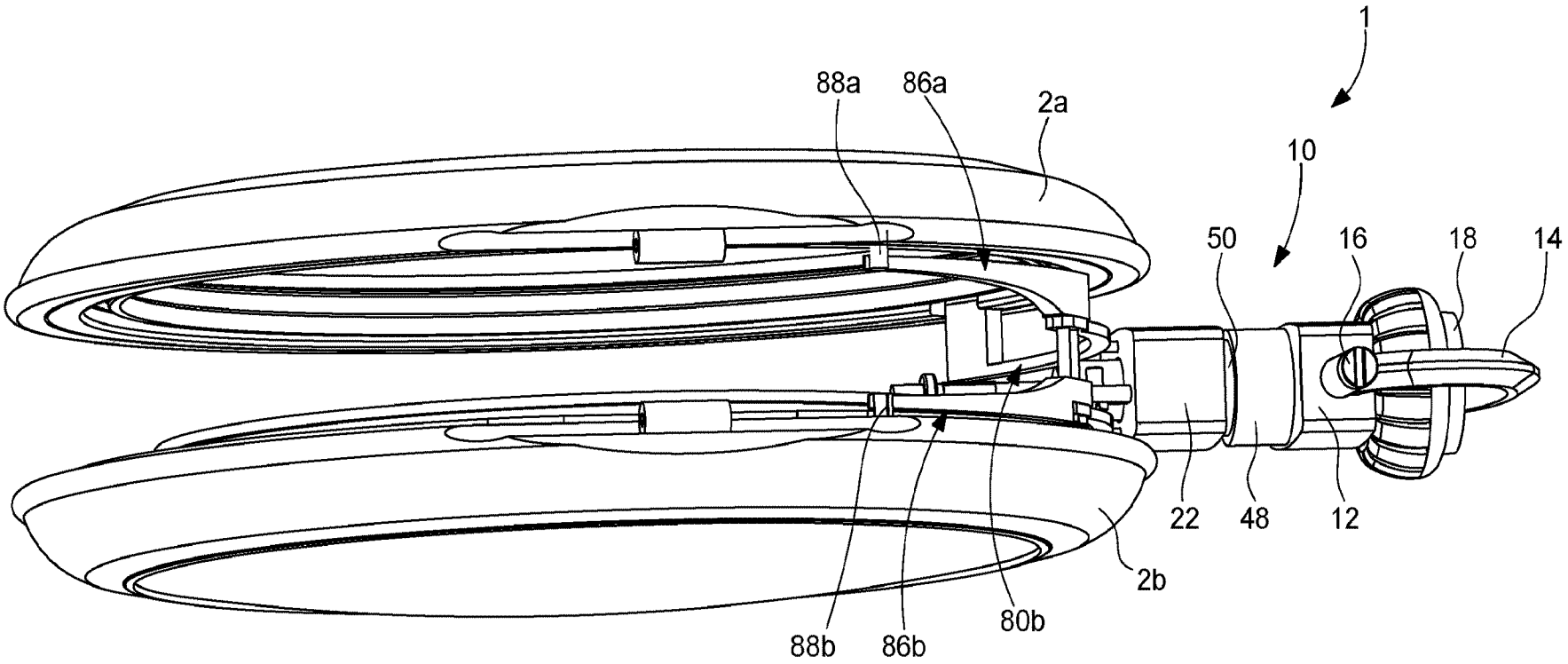
FIG. 10 is a perspective view of the pocket watch on which the middle part is removed to show the opening springs.
Figures 11A, 11B:
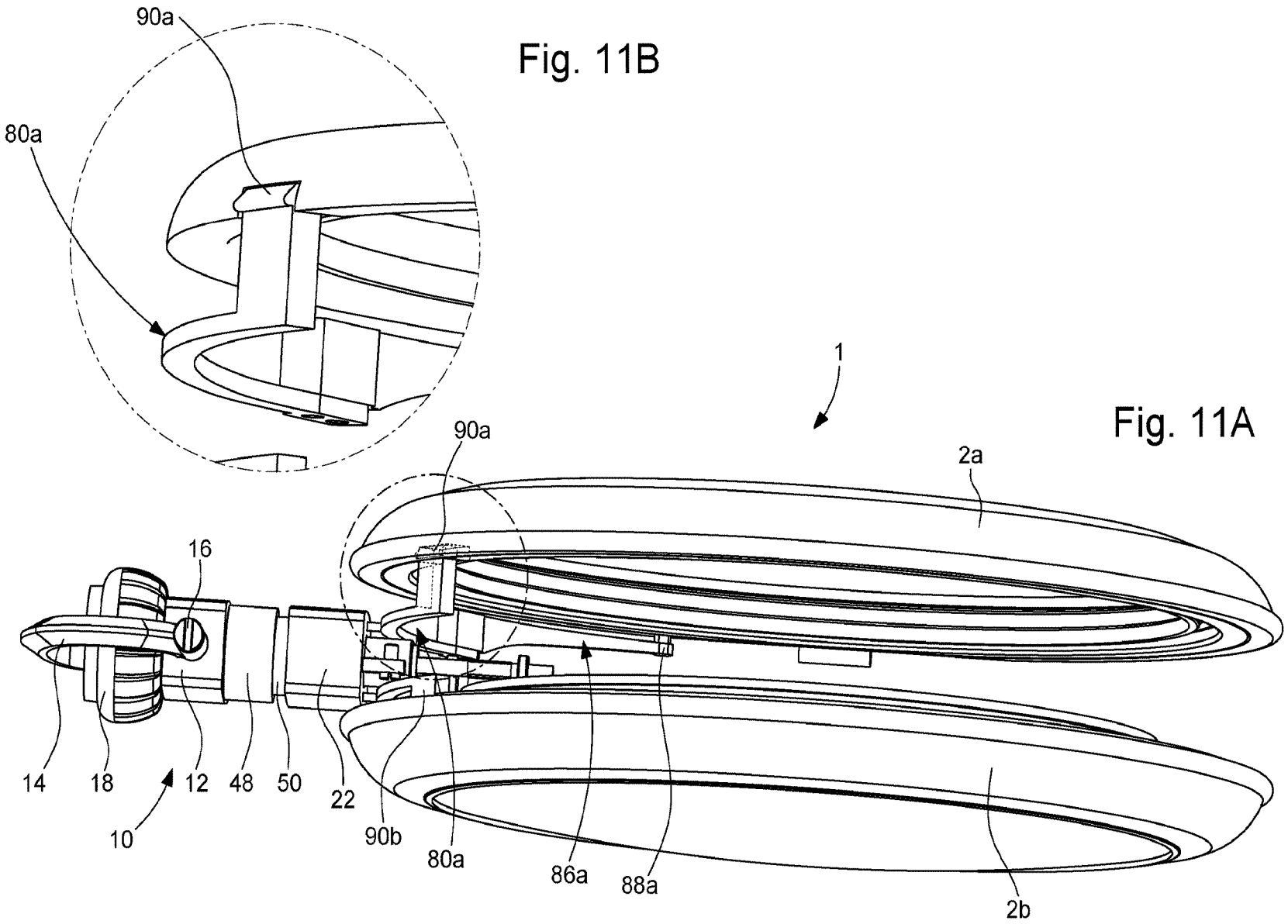
FIG. 11A is a perspective view similar to that of FIG. 10 on which the catches equipping the two opening springs are visible.
FIG. 11B is a detail view at larger scale of the zone encircled by a circle on FIG. 11A.

When at rest, the control device 10 is in a situation wherein the assembly formed by the ring pendant 12 and the ring 14 is repelled by the return spring 42 towards the outside of the case 20 of the pocket watch 1. In this position, the safety pin 54 is in its semi-cylindrical notch 74 and the first and second pegs 56*a*, 56*b* are at a certain distance above the first and second rims 70*a*, 70*b*. From this position, the user looking, for example, to open the first cover 2*a* of the pocket watch 1, must press down on the ring pendant 12 towards the centre of the case 20 of the pocket watch 1, against the return force of the return spring 42. Under the effect of this pushing action, the ring pendant 12 moves closer to the middle 6 of the case of the pocket watch 1, and the pegs 56*a*, 56*b* are located in the immediate vicinity of the first and second rims 70*a*, 70*b*. The safety catch 54, for its part, after being removed from its semi-cylindrical notch 74, is at the height of the first and second grooves 76*a*, 76*b*. Let's suppose that, in order to open the first cover 2*a*, the ring pendant 12 must be rotated in the clockwise direction. In such a case, the safety catch 54 will penetrate the first groove 76*a* and the ring pendant 12 will be able to rotate by about 45° until the safety catch 54 abuts against the stop 77*a* at the bottom of the first groove 76*a*. During this rotational movement, the first and second pegs 56*a*, 56*b* which were initially at rest respectively on the first and second rims 70*a*, 70*b* thereof, will also rotate by 45° such that the second peg 56*b* becomes positioned vertically to the clearance 72, whereas the first peg 56*a* becomes positioned vertically to the first actuating pin 64*a*. The height of the first groove 76*a* in which the safety catch 54 is located is sufficient, after having reached this position, for the user, by pushing down on the ring pendant 12 counter to the return force of the return spring 42, to be able to move this ring pendant 12 axially towards the middle 6 of the case 20 of the pocket watch 1. During this movement, the second peg 56*b* penetrates the clearance 72 and does not have any effect, whereas the first peg 56*a* comes into contact with the first actuating pin 64*a* and forces the latter to move axially towards the middle 6 of the case 20 of the pocket watch 1. It is understood that, in order for the first peg 56*a* to come into contact with the first actuating pin 64*a*, the diameter of the return spring 42 should be less than the diameter of the circle C on which this first peg 56*a* is arranged. It should also be remembered that the axial movement of the first actuating pin 64*a* is made possible by the fact that the holding plate 68 is mounted such that a slight axial play remains between the catches 66*a*, 66*b* of the actuating pins 64*a*, 64*b* and the second bearing surface 79 formed in the middle pendant housing 40, this play defining the travel of the actuating pins 64*a*, 64*b*, which allows them to actuate the springs 80*a*, 80*b* for locking the first and second covers 2*a*, 2*b*. Thus, by moving, the first actuating pin 64*a* will actuate the first locking spring 80*a* which will, in turn, in a manner known per se, command the opening of the first cover 2*a*. More specifically, FIG. 10 shows that the pocket watch 1 according to the invention is equipped with two opening springs 86*a* and 86*b* which are respectively associated with the first and second covers 2*a* and 2*b* and which each comprise a peg 88*a* and 88*b*. When in the closed position, the covers 2*a* and 2*b* bear on the pegs 88*a* and 88*b* of the opening springs 86*a* and 86*b* and cause these opening springs 86*a*, 86*b* to bend in a direction perpendicular to a plane in which the movement of the pocket watch 1 extends. In this situation, the opening springs 86*a*, 86*b* are thus tensioned, however are prevented from relaxing into their resting position because the covers 2*a*, 2*b* are held closed by the locking springs 86*a* and 86*b*. More specifically, as shown in FIGS. 11A and 11B, each of the two opening springs 80*a* and 80*b* are equipped with a catch, respectively 90*a* and 90*b*, which projects into a corresponding cavity formed on the inside face of each cover 2*a*, 2*b*. However, when the user is looking, for example, to open the first cover 2*a* and pushes the ring pendant 12 towards the middle 6 of the case 20 of the pocket watch 1, the first actuating pin 64*a* slightly repels the opening spring 80*a* towards the inside of the case 20 of the pocket watch 1, such that the catch 90*a* leaves the cavity made in the inside face of the cover 2*a*; at this point, the cover 2*a* is no longer retained, which allows the opening spring 86*a* to relax and return to its resting position and cause the cover 2*a* to rotate upwards. The above description of the opening of the first cover 2*a* applies in an identical manner to the opening of the second cover 2*b*.

It is understood that the opening of the second cover 2*b* abides by the same rules as the opening of the first cover 2*a* described above. The ring pendant 12 is rotated by 45° such that the safety catch 54 abuts against the bottom of the second groove 76*b*. During this movement, the first peg 56*a* will become positioned above the clearance 72, whereas the second peg 56*b* will become positioned above the second actuating pin 64*b*. The ring pendant 12 is then pushed axially towards the middle 6 of the case 20 of the pocket watch 1 counter to the return force of the return spring 42. The first peg 56*a* will penetrate the clearance 72 without having any effect, whereas the second peg 56*b* will bear against the second actuating pin 64*b* and cause it to move axially towards the middle 6 of the case 20 of the pocket watch 1. By moving, the actuating pin 64*b* will actuate the second locking spring 80*b* which will, in turn, command in a manner known per se, the opening of the second cover 2*b*.

It is evident that this invention is not limited to the embodiment described above and that various simple alternatives and modifications can be considered by a person skilled in the art without leaving the scope of the invention as defined by the accompanying claims. It should in particular be noted that once the covers 2*a* or 2*b* are open, in order to bring the control device 10 to the inactive position, the ring pendant 12 must simply be rotated 45° backwards in order to bring the safety catch 54 into its semi-cylindrical notch 74 and allow the ring pendant 12 to be pushed backwards into its distal position under the effect of the return spring 42, which relaxes.

Nomenclature

1. Pocket watch
2*a*. First cover
2*b*. Second cover
6. Middle
8. Hinge
X-X. Longitudinal axis of symmetry
9*a*. Dial showing the time
9*b*. Hour hand
9*c*. Minute hand
10. Control device
11*b*. Dial
11*b*, 11*c*. Set of hands
12. Ring pendant
14. Ring
16. Screw
18. Crown
20. Case
22. Middle pendant
24. Ring pipe
26. Middle pipe
28. Threading
30. Ring stop
32. Middle stop
34. First bearing surface
36. Ring pendant housing
38. Distal end
40. Middle pendant housing
42. Return spring
44. Small faces
46. Holes
48. First cylindrical portion
50. Second cylindrical portion
52. Annular surface
54. Safety catch
56*a*. First peg
56*b*. Second peg
C. Circle
D1. Diameter
60. First hole
62. Second hole
64*a*. First actuating pin
64*b*. Second actuating pin
66*a*. First catch
66*b*. Second catch
68. Holding plate
D2. Diameter
70*a*, 70*b*. First and second rims
72. Clearance
74. Semi-cylindrical notch
76*a*, 76*b*. First and second grooves
77*a*, 77*b*. Milling bottom stops
78*a*, 78*b*. First and second bores
79. Second bearing surface
80*a*, 80*b*. First and second locking springs
82. Screw
84. Threaded hole
86*a*, 86*b*. Opening springs
88*a*, 88*b*. Pegs
90*a*, 90*b*. Catches

The invention claimed is:

1. A timepiece comprising:

a case delimited by a middle, the timepiece further including at least one cover covering a device for displaying information, as well as a control device for controlling the opening of the at least one cover, the control device including a ring pendant and a command transmission member, the ring pendant being arranged such that the ring pendant is configured to be pushed in a rectilinear manner a first time towards the middle into a first abutment position, the ring pendant is then configured to be rotated in a first direction into a second abutment position, and then the ring pendant is configured to be pushed in a rectilinear manner a second time towards the middle so as to cause the cover to open by an action on the command transmission member.

2. The timepiece according to claim 1, wherein the transmission member is an actuating pin arranged in order to move axially under the effect of the action of the ring pendant and to actuate a spring which controls the opening of the cover.

3. The timepiece according to claim 2, wherein the control device comprises a middle pendant mounted such that it is fixed onto the middle of the case and has a middle pendant housing in which the ring pendant is inserted and free to slide.

4. The timepiece according to claim 3, wherein the control device comprises a middle pipe engaged in the middle pendant housing of the middle pendant and fixed in the middle of the case of the timepiece, the control device further comprising a ring pipe fixed in the middle pipe, the ring pendant being engaged such that it is free to slide with the interposition of a return spring threaded on the middle pipe and which is sandwiched between the ring pendant and the middle of the case of the timepiece.

5. The timepiece according to claim 4, wherein the ring pipe is equipped, on the outer periphery thereof, with a first collar and a second collar which act as stops, the first collar being arranged such that it is at rest on a first bearing surface situated at the bottom of a ring pendant housing made in the ring pendant, and the second collar being arranged such that it is at rest against a distal end of the middle pipe when the ring pipe is fixed inside the middle pipe.

6. The timepiece according to claim 5, wherein, on the side of the middle of the case of the timepiece, the ring pendant comprises a first and a second cylindrical portion, which are arranged one after the other, the outer diameter of the first cylindrical portion being greater than the outer diameter of the second cylindrical portion.

7. The timepiece according to claim 6, wherein, at a base of the second cylinder, the second cylindrical portion of the ring pendant is provided with a safety catch and with a peg, the safety catch projecting from the outer surface of the second cylindrical portion, whereas the peg is provided at the base of the second cylindrical portion, in the continuation of this second cylindrical portion, the safety catch and the peg being substantially arranged in the same circle (C), the peg being arranged at an angle of more than 0° and less than 90° relative to a diameter (D1) that passes through the safety catch, and is substantially situated opposite this safety catch.

8. The timepiece according to claim 7, wherein the actuating pin is inserted into a bore, axially pierced in a second bearing surface provided in the bottom of the middle pendant housing, the actuating pin being retained in the bore thanks to the catch thereof, which is at rest on the second bearing surface and which prevents this actuating pin from leaving the bore axially in the direction of the middle, the actuating pin being at rest, at the end thereof opposite the catch, on a locking spring, which is arranged in the case of the pocket watch and which controls the opening of the cover, the ring pendant being arranged such that the peg thereof bears against the actuating pin when this ring pendant is pushed in a rectilinear manner a second time towards the middle in order to cause the cover to open.

9. The timepiece according to claim 8, wherein the control device comprises a holding plate fixed inside the middle pendant housing such that the holding plate is situated above the catch of the actuating pin and prevents this actuating pin from leaving the bore axially in the direction of the ring pendant, the holding plate being mounted such that an axial play remains between the catch and the second bearing surface, this play defining the travel of the actuating pin, which allows it to actuate the locking spring of the cover.

10. The timepiece according to claim 1, wherein the timepiece comprises a first and a second cover which respectively cover a first and a second device for displaying information, as well as a device for controlling the opening of the first, and respectively of the second cover, the control device comprising a ring pendant, as well as a first, and respectively a second command transmission member, the ring pendant being arranged such that the ring pendant is pushed in a rectilinear manner a first time towards the middle into a first abutment position, then the ring pendant is rotated in a first direction into a second abutment position, then the ring pendant is pushed in a rectilinear manner a second time towards the middle so as to cause the first cover to open by an action on the first command transmission member, the ring pendant being arranged such that the ring pendant is capable, from the first abutment position, of being rotated in a second direction into a second abutment position, then of being pushed in a rectilinear manner a second time towards the middle in order to cause the second cover to open by an action on the second command transmission member.

* * * * *